US008128343B2

(12) United States Patent
Schiavo et al.

(10) Patent No.: US 8,128,343 B2
(45) Date of Patent: Mar. 6, 2012

(54) RING SEGMENT COOLANT SEAL CONFIGURATION

(75) Inventors: Anthony L. Schiavo, Oviedo, FL (US); Malberto F. Gonzalez, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 859 days.

(21) Appl. No.: 11/928,500

(22) Filed: Oct. 30, 2007

(65) Prior Publication Data

US 2009/0079139 A1 Mar. 26, 2009

Related U.S. Application Data

(60) Provisional application No. 60/974,143, filed on Sep. 21, 2007.

(51) Int. Cl.
*F04D 29/08* (2006.01)

(52) U.S. Cl. ..... 415/116; 415/170.1; 415/214.1

(58) Field of Classification Search ..... 415/173.1
See application file for complete search history.

(56) References Cited

U.S. PATENT DOCUMENTS

| | | | | |
|---|---|---|---|---|
| 5,318,402 | A | 6/1994 | Bailey et al. | |
| 5,988,975 | A | 11/1999 | Pizzi | |
| 6,537,023 | B1 | 3/2003 | Aksit et al. | |
| 6,550,777 | B2 | 4/2003 | Turnquist et al. | |
| 7,011,493 | B2 | 3/2006 | Marchi et al. | |
| 7,033,138 | B2 | 4/2006 | Tomita et al. | |
| 7,104,751 | B2 | 9/2006 | Naik et al. | |
| 2004/0047725 | A1 | 3/2004 | Tomita et al. | |
| 2006/0207094 | A1 | 9/2006 | Allen et al. | |
| 2007/0025837 | A1 * | 2/2007 | Pezzetti et al. | 415/115 |

FOREIGN PATENT DOCUMENTS

| | | | |
|---|---|---|---|
| EP | 1746255 | A2 | 1/2007 |
| WO | 9930009 | A1 | 6/1999 |

* cited by examiner

*Primary Examiner* — Richard Edgar

(57) ABSTRACT

A configuration of seals disposed around and between a plurality of ring segments (10) arrayed annularly about the periphery of moving blades in a gas turbine engine. The seals function to retain coolant in the plenum (18) within each of the ring segments (10). The seals are disposed atop a substrate (16A), which forms the top of the plenum (18). The first seal (25) is made of a piece of sheet material and seals the gap between adjacent ring segments. This seal has an edge (25A) thereof creased for mating with a similar seal on an adjacent ring segment. A second seal (27), which is also made of sheet material, seals the ends of the plenum (18) of the ring segments (10). Lastly, a third seal (29), which is also made of a piece of sheet material, seals the sides of the second seal (27).

20 Claims, 6 Drawing Sheets

RING SEGMENT COOLANT SEAL CONFIGURATION

CROSS REFERENCE TO RELATED APPLICATIONS

This application claims benefit under 35 USC 119(e)(1) of the 21 Sep. 2007 filing date of U.S. provisional application 60/974,143, incorporated by reference herein.

FIELD OF THE INVENTION

The disclosed embodiment of the present invention relates to an array of ring segments disposed annularly about the periphery of moving blades in a gas turbine, and in particular to an improved seal configuration around and between such ring segments in order to retain coolant in a plenum for directing such coolant to components of the ring segments.

BACKGROUND OF THE INVENTION

It is known that the maximum power output of a combustion turbine is achieved by heating the gas flowing through the combustion section to as high a temperature as is feasible. The hot gas, however, heats the various turbine components, such as the combustor, transition ducts, vanes and ring segments, which it passes when flowing through the turbine. The ability to increase the combustion firing temperature is limited by the ability of the turbine components to withstand increased temperatures. Consequently, various cooling methods have been developed to cool turbine hot parts.

As a result of the ever increasing firing temperatures incorporated into modern gas turbine engine designs, the ring segments have required more and more cooling to prevent them from overheating. Even with thermal barrier coatings and ceramic components, active cooling is still necessary. Conventional state-of-the-art cooling systems provide a source of coolant at a pressure substantially higher than the pressure of the heated working gases of the turbine engine. It is therefore necessary to seal the possible escape routes for the coolant air or to at least minimize escape of the coolant air into the working gases of the turbine. In this manner the coolant air is metered in its possible escape routes so that the ring segments are cooled efficiently, as desired. It is therefore preferred that the available cooling air is used as efficiently as possible, since by virtue of the saving of cooling air, considerable power output and efficiency potentials can be realized. Moreover, when a ceramic material is used for the ring segment, it is difficult to form slots or holes therein for accepting coolant seals as may typically be used with metal parts, for fear of damaging the structural integrity of the ceramic components. Hence, a unique problem is presented for shaping and securing the coolant seals for a ceramic ring segment for a gas turbine engine.

BRIEF DESCRIPTION OF THE DRAWINGS

The invention is explained in the following description in view of the drawings that show.

DETAILED DESCRIPTION OF AN EMBODIMENT OF THE INVENTION

Figure 1:
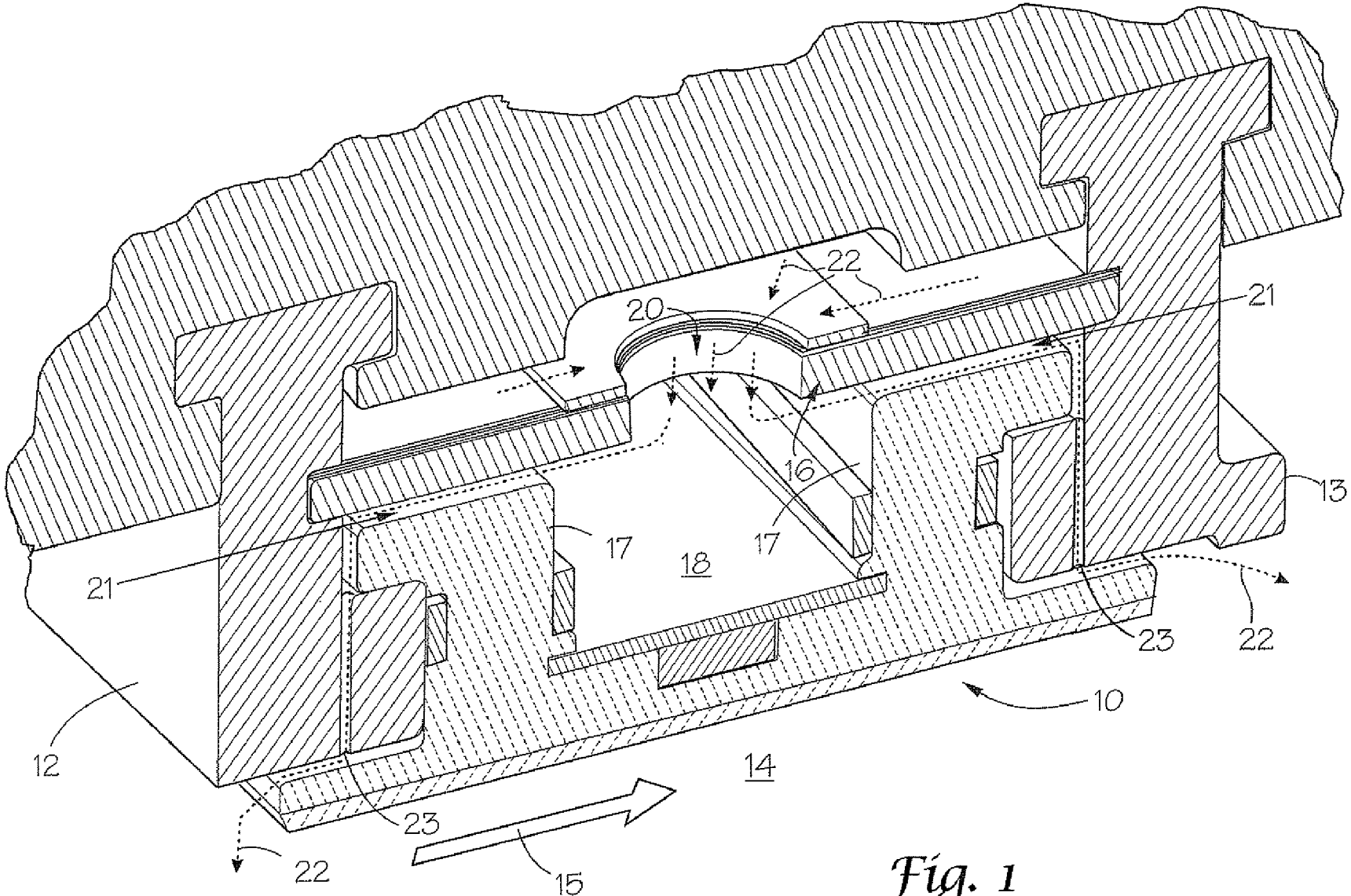
FIG. 1 is a cut-away perspective view of a portion of a coolant plenum structure including a ring segment in accordance with an embodiment of the present invention.

Referring now to the drawings and to FIG. 1 in particular, a cut-away perspective view of a portion of a coolant plenum structure is shown including a ring segment 10, which is assembled from a ceramic matrix composite (CMC) material. The ring segment 10 includes a stacked multiplicity of CMC thin-sheet lamellae each comprising a peripheral surface collectively defining a cross-section profile of the ring segment, as is described in co-pending and commonly assigned U.S. patent application Ser. No. 11/928,407 titled "STACKED LAMELLAE CERAMIC GAS TURBINE RING SEGMENT COMPONENT." Each lamella has a symmetrical body shape with a channel formed in the center thereof for receiving a bow-tie member. The bow-tie member, which is a double wedge, is disposed in the channel for holding together each of the lamella in a through thickness direction, and the in-plane strength of the bow-tie member is perpendicular to the in-plane strength of the lamellae. The channel is widest at each end of the ring segment and most narrow in the center, thereby forming a channel for snuggly receiving the bow-tie member. A top plate is disposed over the bow-tie member for adding further rigidity to the structure.

The ring segment 10 is held in place by a pair of isolation rings 12 and 13, which are typically manufactured of a metal alloy. The isolation ring 12 is upstream in a direction of the flow of working gases moving through a chamber 14 of the turbine structure, whereas isolation ring 13 is downstream in the direction of the working gas movement. Hence, the direction of flow of the working gas is from left to right in FIG. 1 (as denoted by an arrow 15) when the drawing is viewed in a conventional manner. The turbine blades (not shown) rotate in the space immediately below the ring segment within the chamber 14.

A seal assembly stack 16 is disposed over the ceramic ring segment 10 between the isolation rings 12 and 13. The stack 16 and walls 17 of the ring segment 10 create a plenum 18, which conducts a coolant for the structure. The coolant is directed into the plenum 18 through a series of openings 20 formed in the seal assembly stack 16. The coolant, which is typically at a pressure substantially higher than that of the working gas, passes through a small crevice 21 formed between the bottom of the assembly 16 and the top ledges of the ring segment 10, which movement path is denoted by arrows 22. The coolant then passes through small orifices 23 in each of the isolation rings 12 and 13 and on to the working gas chamber 14.

Figure 2:
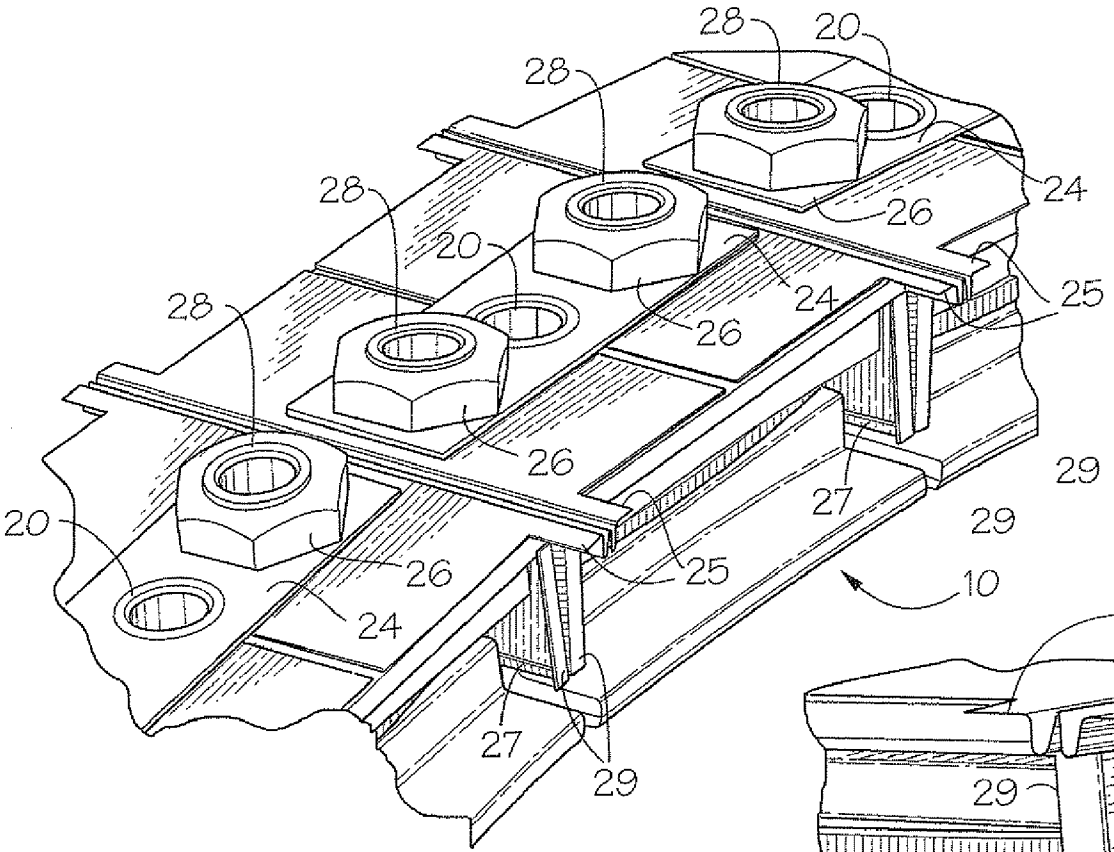
FIG. 2 is a perspective view of the top of a portion of a ring segment in accordance with an embodiment of the present invention.
Figure 3:
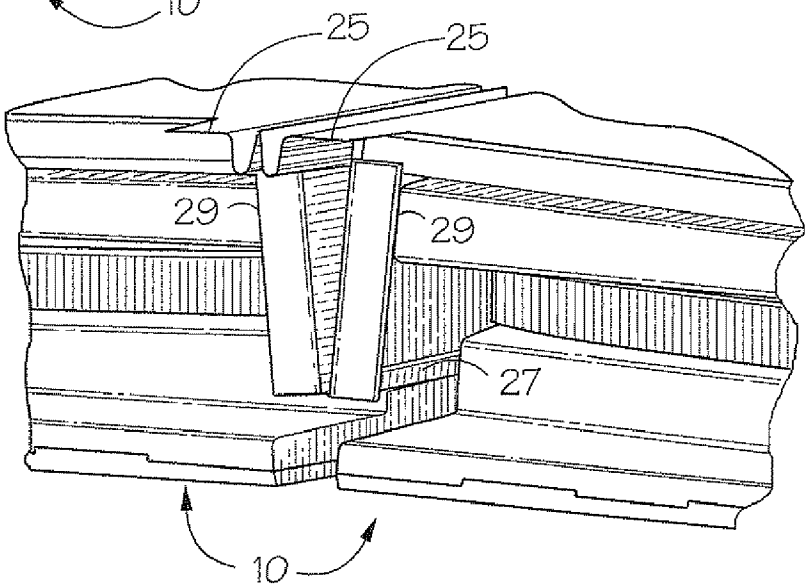
FIG. 3 is a side cut-away view of portion of a ring segment showing the seals in accordance with an embodiment of the present invention.

Referring now to FIGS. 2 and 3, perspective views of the top of a portion of a ring segment, and a side cut-away view of a portion of a ring segment, showing the seals in accordance with an embodiment of the present invention, are shown. There is a multiplicity of ring segments 10 disposed about the inner periphery of the turbine. Coolant air is passed through the openings 20 to the plenum 18 (not shown in FIGS. 2 and 3). In accordance with an embodiment of the present invention, a plurality of seals is added in order to retain the air coolant in the plenum 18 and to meter its escape into the working gas, as stated hereinabove. Since the ring segment 10 is made of a ceramic material, slots or holes cannot be made conveniently in the ring segment for accepting coolant seals. Otherwise, such holes or slots might weaken the structural integrity of the ring segment 10. Hence, the seals are separate components and are held in place by a clamping plate 24 secured by locking nuts 26 threaded onto pipes 28 that are mechanically locked and tack welded onto the substrate 16A in at least some of the openings 20.

First, there is a checkmark seal 25, which extends axially across the top and between adjacent ring segments 10. Second, there is a lap seal 29 that extends vertically along the edge of the ring segment 10. Third, there is a J-hook seal 27 that also extends axially across the lower portion of the ring segment 10, below the bottom surface of the plenum 18. Each of these seals may be made from sheet material, such as a high-temperature nickel-based alloy typically referred to in the industry as UNS NO $600^2$, NO 6625 or NO 7718

Figure 4A:
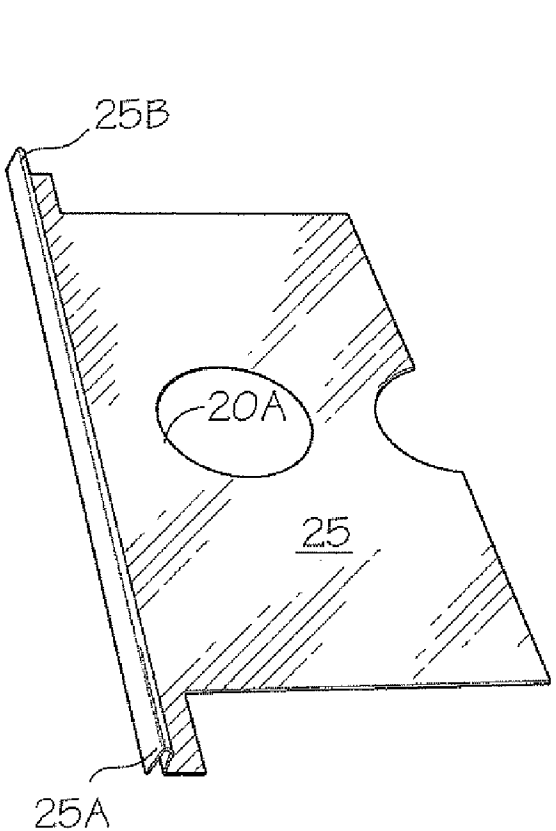
FIGS. 4A-4C show the shape of the individual seals that are made from sheet material.
Figure 4B:
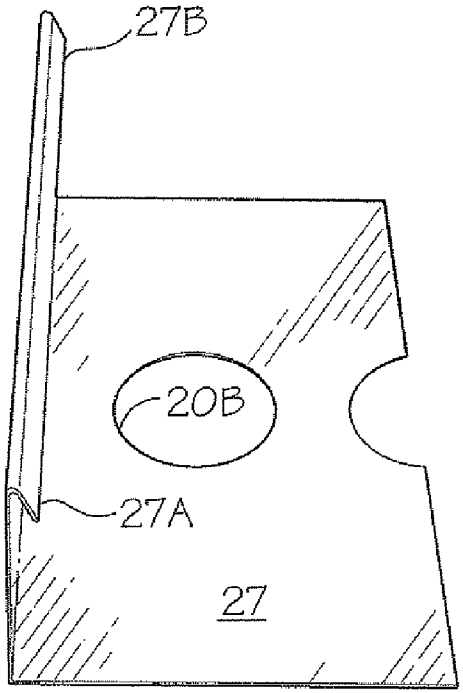
Figure 4C:
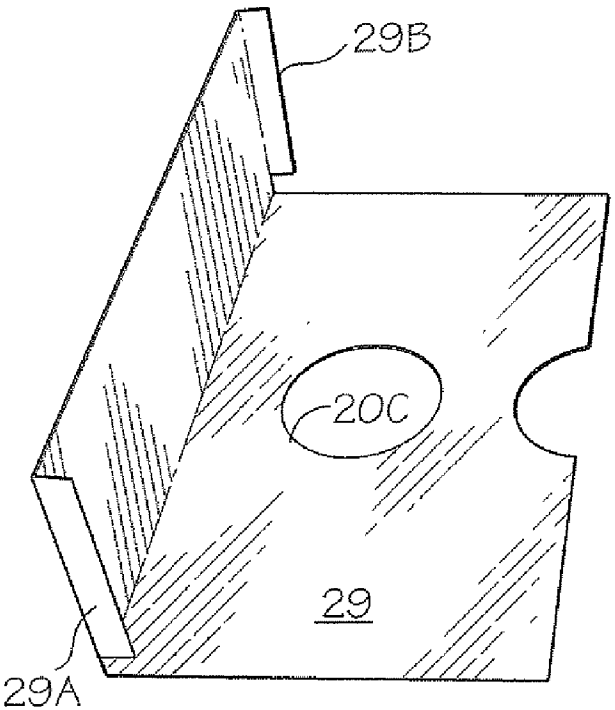

The shape of each of these three seals may be appreciated with reference to FIGS. 4A, 4B and 4C. It is pointed out that in FIGS. 4A, 4B and 4C these three seals are illustrated upside down when compared to their illustration in FIGS. 2 and 3 in order to more clearly show the details thereof. FIG. 4A illustrates the shape of the checkmark seal 25, which is formed from a single piece of sheet material. This seal is referred to as a checkmark seal because its shape approximates a checkmark when viewed from the edge, wherein the checkmark is formed across an edge 25A-25B of the seal, and the edge 25A-25B rides in slots 35 (FIG. 7) in the isolation rings 12 and 13. The checkmark portion 25A-25B of the seal 25 abuts snuggly against a similar checkmark portion of a similar seal on an adjacent ring segment, and the flexibility provided by the checkmark shape allows the seal there between to be maintained even in the event of some differential movement there between. The checkmark seal 25 restrains escape of any cooling air that may escape between the adjacent ring segments. An opening 20A is formed in the center of the seal 25, which aligns with opening 20 of the seal assembly stack 16.

Figure 7:
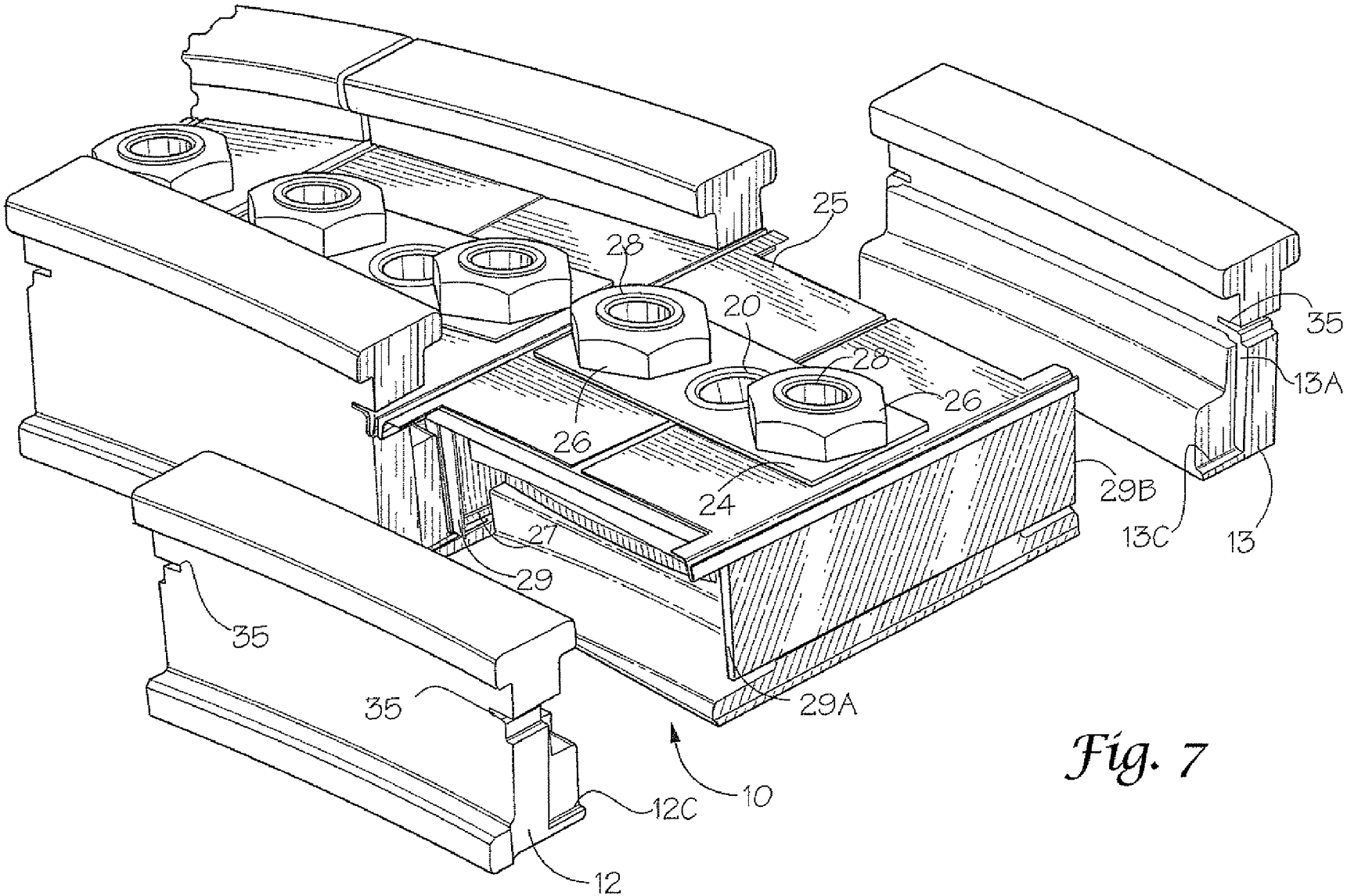
FIG. 7 is an exploded view of the ring segments and their mating isolation rings.
Figure 8:
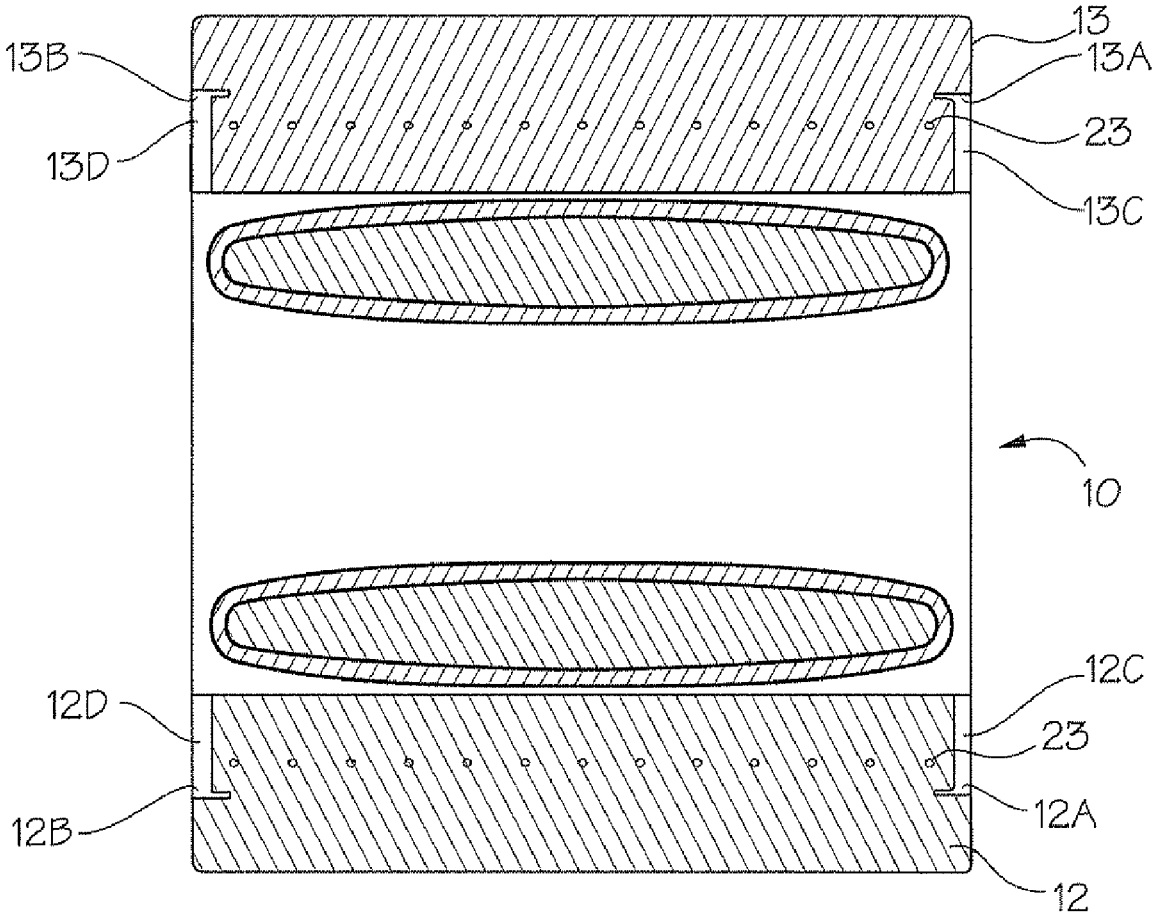
FIG. 8 is a plan view of a ring segment and associated isolation rings, which illustrate the coolant escape orifices.

FIG. 4B illustrates the J-hook seal 27, which also is formed from a piece of sheet material. This seal has a 90° elbow bend (which angle may vary) along one edge thereof and the J-hook bend is formed along a distal edge 27A-27B of the bent elbow portion of the seal. The lip of the J-hook itself is snuggly biased against the end wall of the ring segment 10 and seals off the end of the plenum 18, with the inherent flexibility of the structure accommodating relative motion there between. It is noted that the edge 27A-27B of the J-hook seal rides in recesses 12C-12D and 13C-13D, as shown in FIGS. 7 and 8 hereinafter. An opening 20B is likewise formed in the center of the seal 27 and aligns with the opening 20 of the seal stack 16.

FIG. 4C illustrates the lap seal 29, which is likewise formed from a single piece of sheet material. This seal also has a 90° elbow bend (which angle may vary) along one edge thereof and the lap seals 29A and 29B are formed on the ends of the bend. The lap seals 29A and 29B overlap the ends of the J-hook seal to mitigate escape of the cooling air around the ends thereof. It is noted that the lap seals 29A and 29B slide into slots 12A, 12B and slots 13A, 13B, respectively, as shown in FIG. 8. Likewise, an opening 20C is formed in the center of the seal 29 and aligns with the opening 20 of the seal stack 16. Each of the three seals 25, 27 and 29 are stacked one upon the other, with the openings 20A, 20B and 20C in alignment, which in combination with a substrate 16A and the clamping plate 24 form the seal assembly stack 16.

Figure 5:
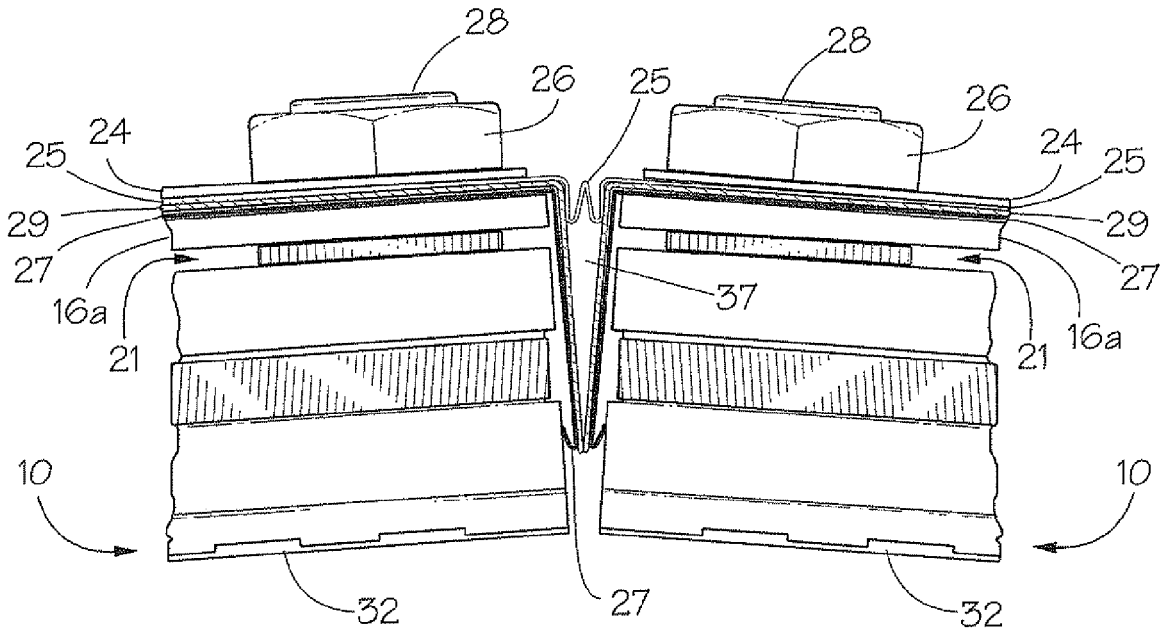
FIG. 5 is another side cut-away view of a portion of a ring segment showing the checkmark and J-hook seals in accordance with an embodiment of the present invention.
Figure 6:
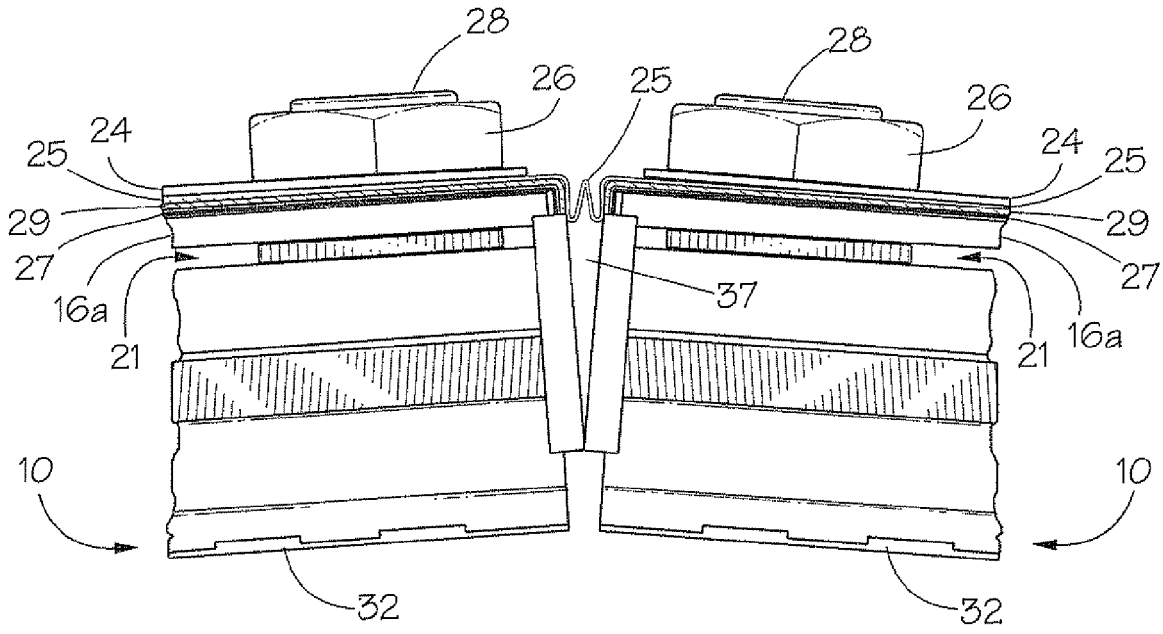
FIG. 6 is the cut-away view of FIG. 4 with the lap seals added in accordance with an embodiment of the present invention.

Referring now to FIG. 5, a side cut-away view of a portion of a ring segment showing the checkmark seal 25 and the J-hook seal 27 in accordance with an embodiment of the present invention are illustrated. The lap seal flaps 29A and 29B are omitted in FIG. 5 for clarity, but are shown in place in FIG. 6. As stated hereinabove, each of the three seals 25, 27 and 29 are stacked one upon the other on top of the stack substrate 16A, with the openings 20A, 20B and 20C in alignment, and is collectively referred to herein as a seal assembly stack 16. A lock nut 26 is threaded onto a pipe 28, which is secured in the opening 20 in the stack 16. This secures all three seals in place, as shown in FIG. 6. The crevice 21 is shown between the bottom surface of the substrate 16A and a top ledge of the ring segment 10. This allows for passage of the coolant as illustrated by arrows 22 in FIG. 1. Note that the J-hook seal 27 of one ring segment abuts the J-hook seal of an adjacent ring segment. This provides a seal of the "V-shaped" space 37 between adjacent ring segments, which blocks entry of the hot working gases from the turbine below into this "V-shaped" space. Note also, that as the engine fires and reaches static temperature, gaps between the J-hook seal 27 and the ends of the ring segment increase and the J-hook seals are biased against one another more tightly. Also, as a result of the spring loads in the seal stacks the gaps are still filled.

Referring now to FIG. 7, an exploded view illustrates the ring segments 10 and their mating isolation rings 12 and 13. As may be appreciated from FIG. 7, slots 35 are formed in the isolation rings 12 and 13 for receiving ends of the checkmark seal 25. Moreover, recesses 12C and 13C are disposed for receiving the ends of the J-hook seal 27; and, slot 13A is disposed for receipt of the folded flap 29B (not shown in FIG. 7) of the lap seal 29. FIG. 8 is a plan view of the ring segment 10 embedded in the isolation rings, which illustrate location of the coolant escape orifices 23. The slots 12A-12B and 13A-13B are disposed for receiving the folded flaps of the lap seal 29; while the recesses 12C-12D and 13C-13D are disposed for receiving ends of the J-hook seal 27. Note that the race track shape of the top part of the ring segment 10 allows coolant air to pass around the ends of the race track and on to the escape orifices 23.

Accordingly, what has been described and illustrated herein is a seal configuration disposed around and between a multiplicity of ring segments 10 arrayed annularly about the periphery of moving blades in a gas turbine. The seals function to retain coolant in the plenum 18 within each of the ring segments. The seals are secured atop the substrate 16A, which forms the top of the plenum 18. The first seal 25 is made of a single piece of sheet material and seals the gap between adjacent ring segments. This seal has an edge 25A thereof creased for mating with a similar seal on an adjacent ring segment. A second seal 27, which is also made of a single piece of sheet material, seals the ends of the plenum 18 of the ring segments 10. Lastly, a third seal 29, which is also made of a single piece of sheet material, seals the sides of the second seal 27. The three seals may be supported on a substrate providing a degree of strength to the stack, or alternatively, the stack may be adequately strong without a separate substrate. It is pointed out that the three seals 25, 27 and 29 require compression from corresponding seals of an adjacent ring segment in order to provide a complete coolant circuit. Moreover, as the turbine heats up the metallic seals expand and bind more snuggly against one another and the ring segment so as to more tightly seal the coolant plenum.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. In an array of ring segments disposed annularly about a periphery of moving blades in a gas turbine, a configuration of seals associated with respective adjacent ones of said ring segments for retaining coolant in a plenum within each of said ring segments, said configuration comprising:

a first seal disposed over at least a portion of a plenum of a ring segment and comprising a creased edge thereof for contacting and sealing against an edge of an associated seal on an adjacent ring segment;

a second seal disposed over at least a portion of said plenum and comprising an angled distal portion at least partially defining an end of said plenum; and a third seal disposed over at least a portion of said plenum and comprising an angled side portion disposed for sealing a gap between said distal portion of the second seal and said ring segment.

2. The configuration as in claim 1 wherein said creased edge of said first seal comprises a checkmark crease.

3. The configuration as in claim 1 wherein said angled distal portion of said second seal comprises a J-hook crease for abutting against an end of said ring segment.

4. The configuration as in claim 1 wherein said angled side portion of said third seal comprises a lap seal.

5. The configuration as in claim 1 and further comprising:

a first opening formed in the first seal;

a second opening formed in the second seal and aligned with said first opening; and a third opening formed in the third seal and aligned with said first and second openings for passage of coolant there through into the plenum.

6. The configuration as in claim 1 further comprising a substrate disposed between said plenum and said seals and providing support for said configuration of seals.

7. The configuration as in claim 6 further comprising a locking plate atop all of said seals for securing them to the substrate, wherein said seals, said locking plate and said substrate comprise a seal stack assembly.

8. The configuration as in claim 7 further comprising:

a pipe secured in an opening in the substrate and passing through respectively aligned openings in said first, second and third seals for the passage of coolant into the plenum; and a locking nut threaded onto said pipe stop said locking plate for binding together said seal stack assembly.

9. In an array of ring segments supported between a pair of isolation rings and all being disposed annularly about a periphery of moving blades in a gas turbine, a configuration of seals for directing coolant through a plenum of one of said ring segments, said configuration comprising:

a substrate defining a top of said plenum and comprising an opening therein, said substrate supported by said isolation rings in a spaced relationship with a top surface of said ring segment thereby defining a crevice;

a pipe comprising a first end secured in said substrate opening for passage of coolant into said plenum and crevice;

a first seal supported by said substrate, the first seal comprising an edge thereof creased for mating with an associated seal on an adjacent ring segment, said first seal being made of sheet material and comprising an opening therein aligned with said opening in said substrate and surrounding said pipe;

a second seal supported by said substrate and comprising an angled distal portion at least partially defining an end of said plenum, said second seal being made of a piece of sheet material and comprising an opening therein aligned with said openings in said substrate and said first seal and surrounding said pipe;

a third seal supported by said substrate and comprising an angled distal portion for sealing the sides of said second seal, said third seal being made of a piece of sheet material and comprising an opening therein aligned with said openings in said substrate, said first seal and said second seal and surrounding said pipe;

a locking plate disposed atop all of said seals for securing then to the substrate, wherein said seals, said locking plate and said substrate comprise a seal stack assembly;

a locking nut threaded onto a second end of said pipe for binding together said seal stack assembly; and a multiplicity of coolant passages formed in each of said isolation rings and in fluid communication with said crevice for metering passage of said coolant through said plenum and said crevice for cooling of the isolation rings.

10. The seal configuration as in claim 9 wherein said first seal includes a checkmark crease along an edge thereof for mating with a similar checkmark crease of a first seal in an adjoining ring segment.

11. The seal configuration as in claim 9 wherein said second seal includes a ninety degree bend in an end thereof with a J-hook crease along an edge of said ninety degree bend for abutting against an end of said ring segment and sealing said plenum.

12. The seal configuration as in claim 9 wherein said third seal includes a ninety degree bend in an end thereof and a pair of lap seals formed on either side of said ninety degree bend for sealing the ends of said second seal.

13. The configuration as in claim 9 further including isolation rings disposed on either side of said ring segments for support thereof in said turbine.

14. The configuration as in claim 13 wherein said isolation rings include first slots therein for receiving ends of said first seal.

15. The configuration as in claim 13 wherein said isolation rings include second slots therein for receiving ends of said angled distal portions of said third seal.

16. The configuration as in claim 13 wherein said isolation rings include recesses therein for receiving ends of said angled distal portions of said second seal.

17. In an array of ring segments disposed annularly about the periphery of moving blades in a gas turbine, a configuration of seals associated with respective adjacent ones of said ring segments for retaining coolant in a plenum within each of said ring segments, said configuration comprising:

a substrate disposed on top of said plenum for supporting a seal assembly stack, said substrate comprising an opening therein for passage of said coolant into said plenum; and said seal assembly stack comprising:

a J-hook seal supported by said substrate and extending to contact a side of said ring segment for sealing an end of said plenum; and a lap seal supported by said substrate and extending to contact a side of the J-hook seal and a side of said ring segment for sealing an end of said J-hook seal.

18. The configuration as in claim 17 wherein said seal assembly stack further comprises a checkmark seal supported by said substrate and comprising a creased distal end extending to contact a similar seal on an adjacent ring segment.

19. The configuration as in claim 18 further including isolation rings disposed on either side of said ring segments for support thereof in said turbine, said isolation rings including slots therein for receiving ends of said checkmark seal.

20. The configuration as in claim 17 where said J-hook seal of a ring segment abuts against the J-hook seal of an adjacent ring segment, thereby forming a seal against hot working gases from said turbine entering into a space between said adjacent ring segments.

* * * * *